United States Patent [19]

Cowles

[11] 4,433,225

[45] Feb. 21, 1984

[54] KEYTOP LEVELLING MECHANISM

[75] Inventor: Dean S. Cowles, Spokane, Wash.

[73] Assignee: General Instrument Corporation, New York, N.Y.

[21] Appl. No.: 468,127

[22] Filed: Feb. 22, 1983

[51] Int. Cl.[3] ..... H01H 3/12

[52] U.S. Cl. ..... 200/340

[58] Field of Search ..... 200/5 A, 159 R, 159 A, 200/159 B, 340; 248/584, 585

[56] References Cited

U.S. PATENT DOCUMENTS

| | | | |
|---|---|---|---|
| 3,144,270 | 8/1964 | Bilancia | 248/584 |
| 3,741,512 | 6/1973 | Olsson | 248/585 |
| 3,916,150 | 10/1975 | Abernethy et al. | 200/340 |
| 3,940,578 | 2/1976 | Pointon | 200/340 |
| 4,392,037 | 7/1983 | Fleming | 200/340 |

FOREIGN PATENT DOCUMENTS

| | | | |
|---|---|---|---|
| 2309367 | 11/1976 | France | 248/584 |

*Primary Examiner*—John W. Shepperd

*Attorney, Agent, or Firm*—Barry R. Lipsitz

[57] ABSTRACT

A keytop levelling mechanism for use in conjunction with a keytop having a main portion and a stem portion cantilevered from the main portion, e.g., an L-shaped keytop. When pressed, the keytop actuates a keyswitch mounted on a circuit board. The levelling mechanism comprises a pair of lever arms joined at intermediate portions thereof by a pivot to form a scissors-like linkage. The scissors-like linkage is mounted between the stem portion of the keytop and the circuit board in a manner such that it collapses in scissor-like fashion when the keytop is pressed toward the circuit board. In this manner, the scissor-like linkage maintains the keytop level throughout its movement toward and away from the circuit board.

9 Claims, 12 Drawing Figures

KEYTOP LEVELLING MECHANISM

BACKGROUND OF THE INVENTION

The present invention relates to keyboards for use in computer terminals, typewriters, and the like, and more particularly to a mechanism for maintaining an oddly-shaped keytop level during its downward and upward travel when used on a keyboard.

Various types of keyboards are used on typewriters, computer terminals and the like for typing or entering data into a computer. Such keyboards are typically manufactured from a plurality of separate keyswitches which are lined up on a circuit board. Each individual keyswitch has a keytop thereon which is generally stamped or otherwise marked with the number or letter which that keyswitch represents. Thus, a keyboard for a conventional typewriter will have something on the order of 50 separate keyswitches, 26 of them representing the letters of the alphabet, 10 representing the digits 0–9, with additional switches for various punctuation and machine functions.

Most keytops used in conventional keyboards are square or rectangular in shape. However, for some machine functions, keytops of different shapes are used. One shape which is often used for certain keyboard functions is an L-shaped keytop. Such keytops provide a convenient way of increasing the useable keytop area by providing an extension into an adjacent row of the keyboard without upsetting the esthetics of the keyboard. Typically, one portion of the L-shaped keytop is used while typing on the main or "alpha" portion of the keyboard while the other portion of the keytop (usually the "ascender" portion of an L-shaped keytop) is used while making entries on an auxiliary group of keyswitches located beside the main keyboard array. It is therefore important that an oddly-shaped keytop, such as an L-shaped keytop, be capable of use by pressing any part thereof. This feature is known as "full top surface utilization".

Full top surface utilization of oddly-shaped keytops is often difficult to provide, e.g., when used in conjunction with low profile keyswitches, when the keyswitch itself does not provide sufficient support for the entire keytop.

In the past, attempts to provide full top surface utilization of L-shaped keytops have not been entirely adequate. The objective of any solution is to prevent the keyswitch from binding when pressing the keytop at a point which is not directly over the keyswitch. One prior solution has been to limit the useable area of the keytop so that the forces created by a keyboard user pressing upon the keytop are directed to an area compatible with the action of the keyswitch. A disadvantage of this solution, however, is that the limited area defeats the purpose of the specially shaped keytop, i.e., the provision of additional keytop area. Another solution has been to incorporate a lever stabilizer mechanism similar to those used for multi-wide keytops such as space bars. However, due to the limited widths that can be obtained in oddly shaped keytops, for example in the narrow ascender portion of an L-shaped keytop, such lever stabilizer mechanisms are not adequate.

It would be advantageous to provide full top surface utilization of an oddly shaped keytop, such as an L-shaped keytop, along with smooth, level keyswitch actuation. Such features should be available even when only a narrow keytop section, such as a narrow ascender portion of an L-shaped keytop, is to be maintained level. Such a levelling mechanism should be economical, easy to manufacture, and capable of being fabricated from a minimal number of parts. This invention relates to such a keytop levelling mechanism.

SUMMARY OF THE INVENTION

In accordance with the present invention, a keytop levelling mechanism is provided. The levelling mechanism is adapted for use in conjunction with a keytop which has a main portion along with a stem portion cantilevered from the main portion. The keytop is used to actuate a keyswitch, which is mounted on a circuit board. The levelling mechanism comprises a pair of lever arms joined at intermediate portions thereof by a pivot to form a scissors-like linkage having first, second, third, and fourth ends. Means is provided for pivotally mounting the first and second ends to longitudinally opposed ends of the cantilevered portion of the keytop. Means is also provided for pivotally mounting the third and fourth ends to separate joints adjacent the circuit board under the cantilevered portion. Finally, means is provided for enabling at least one end of each lever arm to slide in addition to pivot.

In a preferred embodiment, the first and second ends of the scissors-like linkage are designed to pivot and slide within the cantilevered portion of the keytop. In this preferred embodiment, the design can be such as to also allow a certain amount of sliding motion at the third and fourth ends of the scissors-like linkage. Such pivoting and sliding motion can be provided through the use of studs projecting from the first, second, third, and fourth ends, along with slots into which the studs protrude.

The structure of the keytop levelling mechanism is such that the lever arms collapse in scissor-like fashion when the keytop is pressed toward the circuit board. This arrangement serves to maintain the keytop, and particularly the cantilevered portion thereof, level throughout its movement toward and away from the circuit board.

DETAILED DESCRIPTION OF A PREFERRED EMBODIMENT

Figure 1:
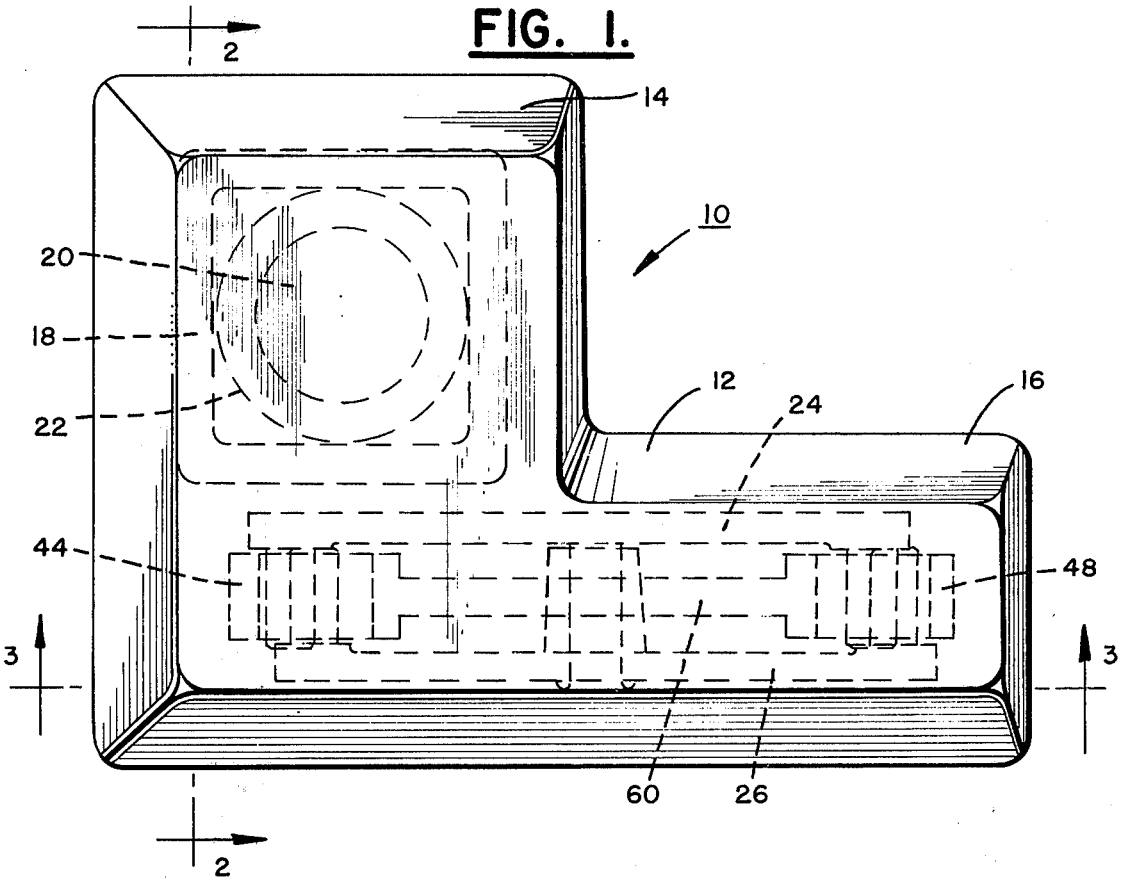
FIG. 1 is a top plan view of an L-shaped keytop mounted on a keyswitch with the levelling mechanism of the present invention mounted under the ascender portion of the L-shaped keytop.

Referring now to the drawings, wherein like numbers indicate like elements throughout the several views, there is shown in FIG. 1 a keyswitch assembly 10 which includes a keytop 12 having a main portion 14 and a stem portion 16 cantilevered from main portion 14. Main portion 14 is mounted to a plunger 20 of a keyswitch 18 which is mounted on a circuit board 70. A spring 22 maintains the plunger 20 and hence keytop 12 in an extended position, away from circuit board 70, when the keytop is not being pressed down by a keyboard user.

Figure 2:
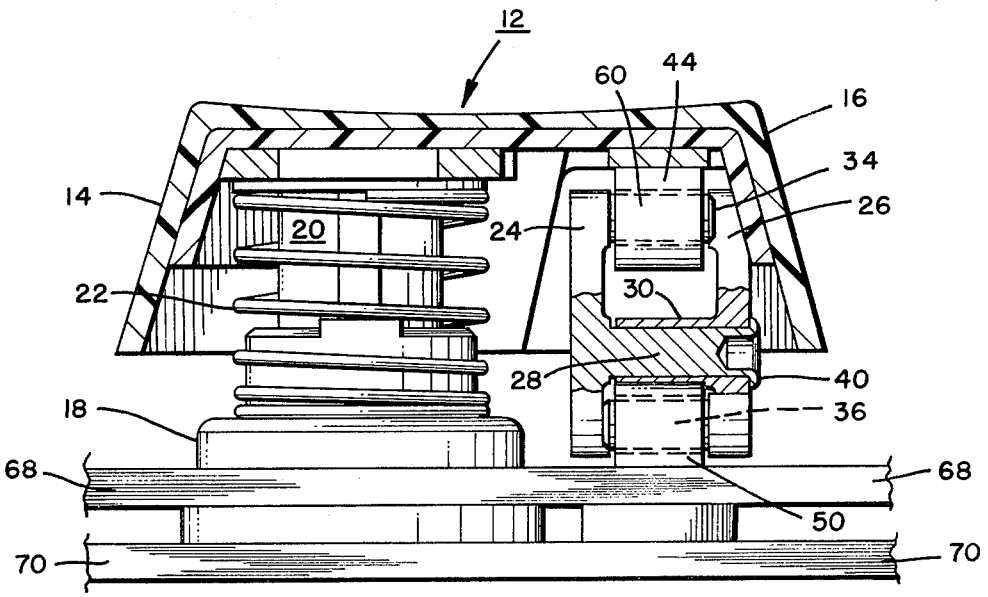
FIG. 2 is a cross-sectional view taken substantially along the line 2—2 shown in FIG. 1.
Figure 3:
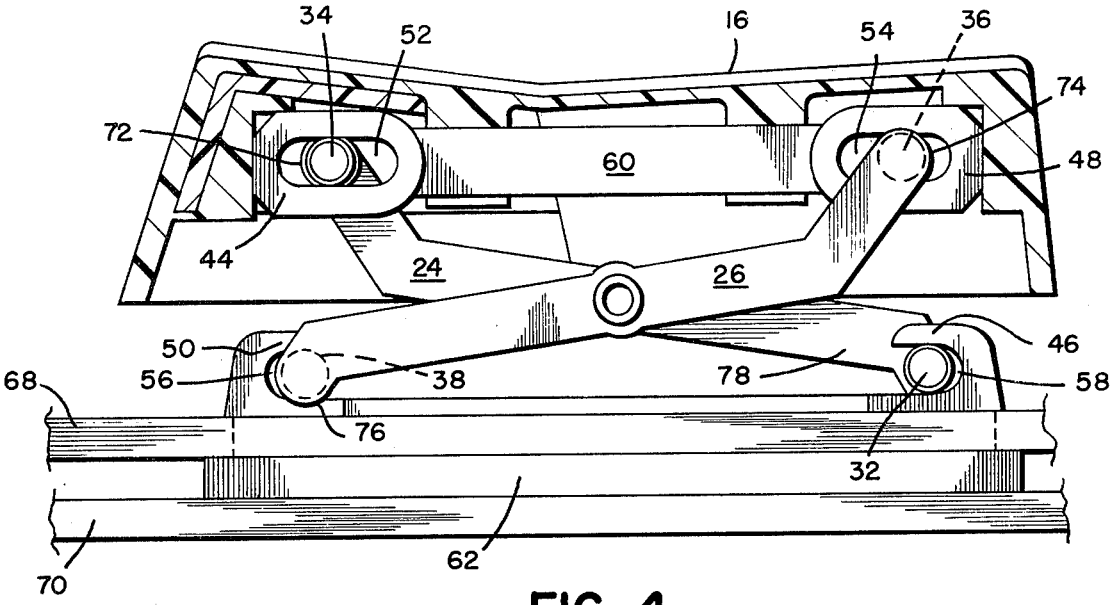
FIG. 3 is a cross-sectional view taken substantially along the line 3—3 shown in FIG. 1 with the keytop in its extended, non-actuated position.
Figure 4:
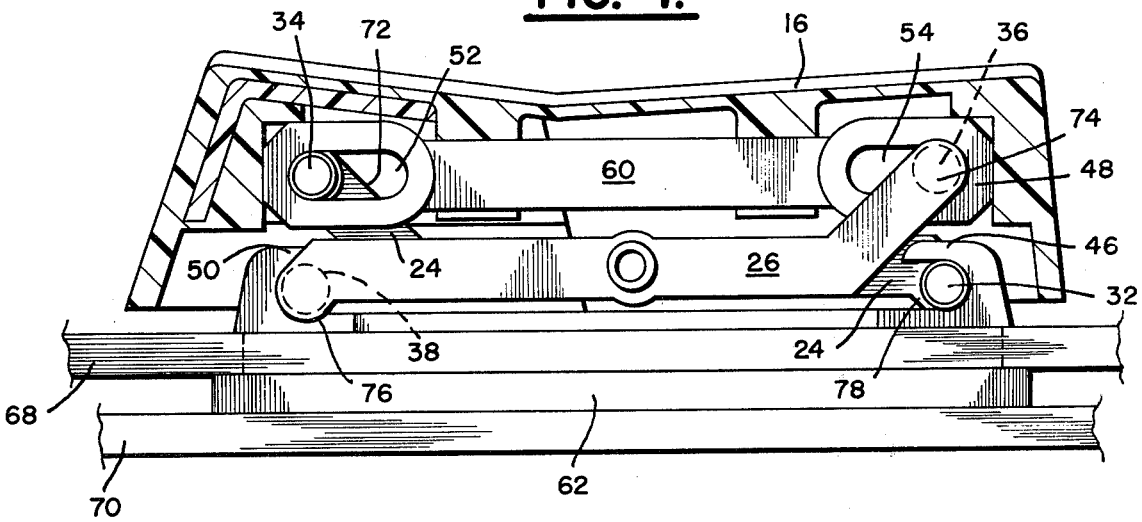
FIG. 4 is a cross-sectional view taken substantially along the line 3—3 of FIG. 1 with the keytop in its depressed, actuated position.
Figure 5:
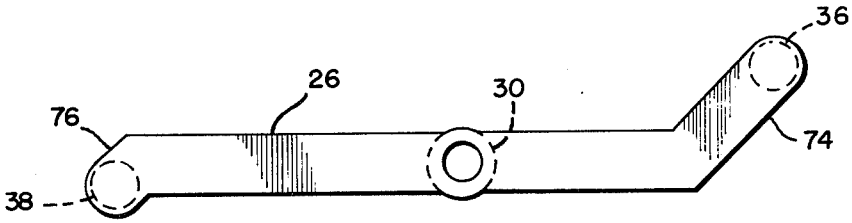
FIG. 5 is a plan view of one lever arm used in the levelling mechanism of the present invention.
Figure 6:
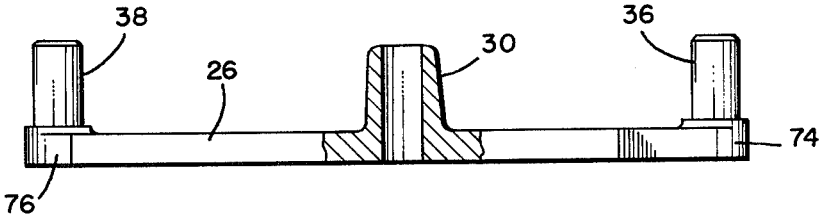
FIG. 6 is a side view in partial cross-section of the lever arm shown in FIG. 5.
Figure 7:
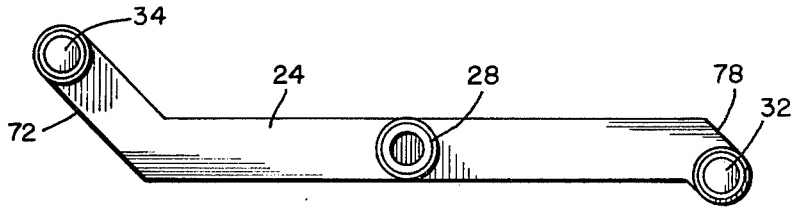
FIG. 7 is a plan view of another lever arm used in the levelling mechanism of the present invention.
Figure 8:
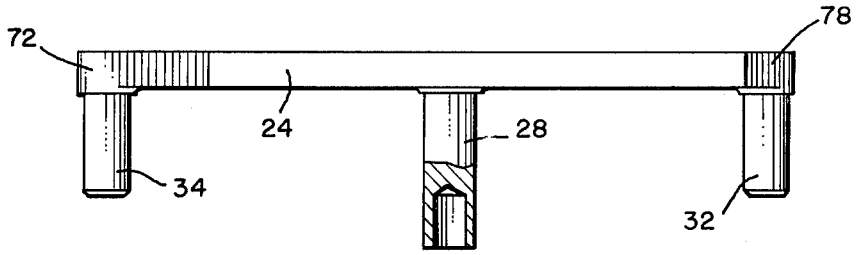
FIG. 8 is a side view in partial cross-section of the lever arm shown in FIG. 7.

Referring now to FIGS. 2 through 4 of the drawings, the keytop levelling mechanism of the present invention is shown in detail. For comparison purposes, FIG. 3 is a cross sectional view of the levelling assembly when the keytop is in its extended, non-actuated position, and FIG. 4 is essentially the same cross section but with the keytop in its depressed, actuated position. A pair of lever arms 24 and 26 are joined approximately at the centers thereof by a pivot to form a scissors-like linkage having first, second, third, and fourth ends 72, 74, 76, and 78 respectively. Lever arm 24 is shown in greater detail in FIGS. 7 and 8. Lever arm 26 is shown in greater detail in FIGS. 5 and 6.

The pivot at which lever arms 24 and 26 are joined comprises a shaft 28 extending from lever arm 24 which projects into a collar 30 on lever arm 26. Flange 40 (see FIG. 2) at the end of shaft 28 (produced, e.g., by ultrasonic forming) provides a locking arrangement which holds lever arms 24 and 26 together after shaft 28 has been fully inserted into collar 30.

Figure 9:
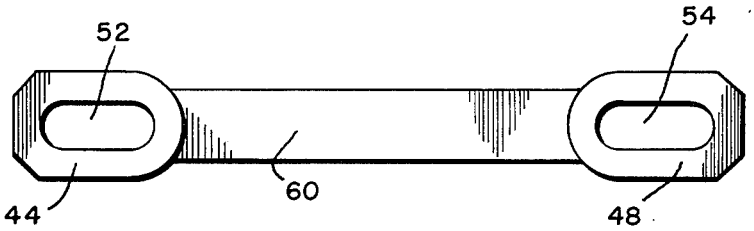
FIG. 9 is a side view of the keytop block used in the levelling mechanism of the present invention.
Figure 10:
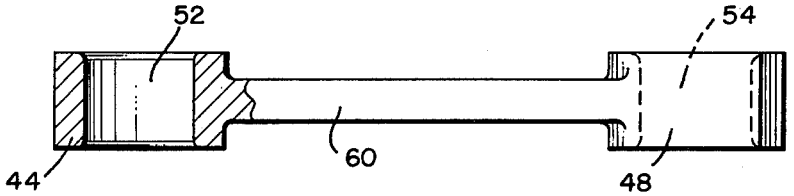
FIG. 10 is a top view in partial cross-section of the keytop block shown in FIG. 9.

Keytop 12 is substantially hollow, and the hollow portion of cantilevered portion 16 thereof provides a cavity into which the scissors-like linkage formed from lever arms 24 and 26 extends. A keytop block 60 is mounted in cantilevered portion 16 of keytop 12 to provide a means for pivotally mounting first end 72 of lever arm 24 and second end 74 of lever arm 26. Keytop block 60 is shown in greater detail in FIGS. 9 and 10, and may be mounted in cantilevered portion 16 by conventional heat-staking techniques.

A stud 34 projects from first end 72 of lever arm 24 and protrudes into slot 52 in keytop block 60. Similarly, a stud 36 projects from second end 74 of lever arm 26 and protrudes into slot 54 of keytop block 60. The combination of studs 34 and 36 with slots 52 and 54 provides an articulating joint which allows both pivoting and sliding motion.

Figure 11:
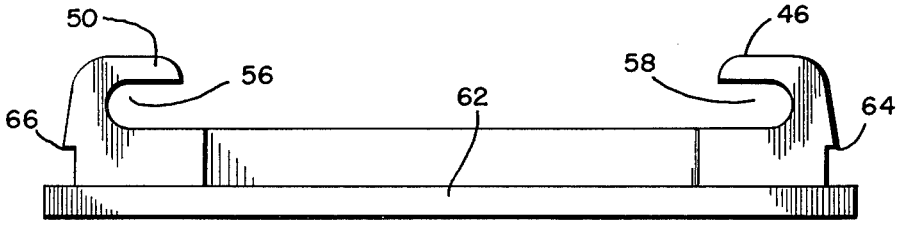
FIG. 11 is a side view of the frame block used in the levelling mechanism of the present invention.
Figure 12:
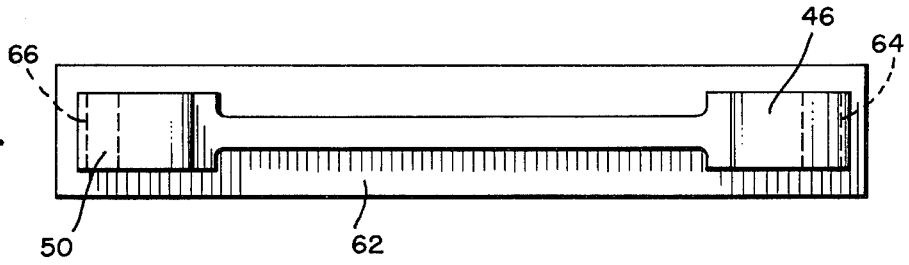
FIG. 12 is a top view of the frame block shown in FIG. 11.

In the keyswitch structure shown, a metal frame 68 is situated above circuit board 70. Frame 68 serves to hold keyswitch 18 in place over circuit board 70. The actual electrical connections to keyswitch 18 are made on circuit board 70. Frame 68 also serves to hold a frame block 62 which provides articulating joints for third and fourth ends 76 and 78 of the scissors-like linkage formed from lever arms 24 and 26. As more clearly shown in FIGS. 11 and 12, frame block 62 includes openings, or slots 56 and 58. A stud 38 projecting from third end 76 of lever arm 26 protrudes into opening 56 of frame block 62. Similarly, a stud 32 projecting from fourth end 78 of lever arm 24 protrudes into opening 58 of frame block 62. Openings 56 and 58 provide for pivotal motion and a certain amount of slidable motion of third and fourth ends 76 and 78 respectively.

Ears 64 and 66 are provided on frame block 62 to lock frame block 62 into frame 68. U-shaped openings 56 and 58 are formed by projections 50 and 46 respectively which extend from frame block 62.

As clearly shown in the Figures, the levelling mechanism of the present invention utilizes a scissors-like linkage which extends for substantially the full length of stem portion 16 of keytop 12. In an L-shaped keytop of the type illustrated, the stem portion 16 is often referred to as the "ascender" portion. By placing the levelling mechanism across the full length of the ascender, rather than the width thereof, a vastly improved operation is achieved which insures a smooth operation of the keyswitch and maintains the keytop level throughout its downward travel toward circuit board 70 and its upward travel away from circuit board 70. Pressing on any side of the keytop will cause one side of the scissors-like linkage formed from lever arms 24 and 26 to close. Closing one side will naturally close the other, pulling the keytop down parallel to circuit board 70. This operation is clearly shown in FIGS. 3 and 4.

In comparing FIGS. 3 and 4, it can be seen that when keytop 12 travels from its upward (non-actuated, extended) position to its downward (actuated, depressed) position, stud 34 of lever arm 24 moves outwardly within slot 52 and stud 36 of lever arm 26 moves outwardly in slot 54. Studs 34 and 36 will also rotate, or pivot, to a certain extent within slots 52 and 54 respectively as the keytop is pressed down. Similarly, stud 38 of lever arm 26 and stud 32 of lever arm 24 will rotate, or pivot, and slide outwardly in U-shaped openings 56 and 58 respectively. Since stem portion 16 is substantially hollow, it provides an area into which the scissors-like linkage becomes contained as arms 24 and 26 collapse upon the downward travel of keytop 12.

Those skilled in the art will appreciate that modifications can be made to the shape of lever arms 24 and 26. Similarly, modifications can be made in the mounting mechanisms provided by keytop block 60 and frame block 62. For example, two pivoting joints can be provided along with two sliding joints. It is not mandatory that the sliding joints be provided in the keytop; they can alternatively be provided adjacent the circuit board 70. Alternatively, keytop 12, and specifically stem portion 16 thereof could include one pivoting joint with a corresponding pivoting joint mounted therebelow adjacent circuit board 70, and one sliding joint with a corresponding sliding joint mounted therebelow adjacent circuit board 70. Thus, while only a single preferred embodiment of the present invention has been disclosed for purposes herein, it is to be understood that many variations and modifications could be made thereto. It is intended to cover all of these variations and modifications which fall within the scope of the present invention as defined by the claims appended hereto.

I claim:

1. A keytop levelling mechanism for use in conjunction with:

a keytop having a main portion and a stem portion cantilevered from said main portion; and a keyswitch, mounted on a circuit board, which is adapted to be actuated when said keytop is pressed;

said levelling mechanism comprising:

a pair of lever arms joined at intermediate portions thereof by a pivot to form a scissors-like linkage having first, second, third, and fourth ends;

means for pivotally mounting said first and second ends to longitudinally opposed ends of said cantilevered portion;

means for pivotally mounting said third and fourth ends to separate joints adjacent said circuit board under said cantilevered portion; and means for enabling at least two of said first, second, third, and fourth ends to slide in addition to pivot.

2. The mechanism of claim 1 wherein said first and second ends are enabled to slide in addition to pivot.

3. The mechanism of claim 2 wherein said means for pivotally mounting said first and second ends and said enabling means comprises a keytop block mounted within said cantilevered portion, said keytop block including first and second slots into which studs, projecting from said first and second ends respectively, protrude to provide a mounting allowing both pivoting and sliding motion.

4. The mechanism of claim 3 wherein said means for pivotally mounting said third and fourth ends comprises a frame block mounted adjacent and in fixed relation to said circuit board, said frame block including third and fourth openings into which studs, projecting from said third and fourth ends respectively, protrude to provide a mounting allowing pivoting motion.

5. The mechanism of claim 4 wherein said third and fourth openings are slots which allow sliding motion in addition to pivoting motion.

6. The mechanism of claim 1 wherein said keytop is L-shaped.

7. A keytop levelling mechanism for use in conjunction with a substantially hollow L-shaped keytop, said mechanism comprising:

a scissors-like linkage having first, second, third, and fourth ends adapted to fit between the ascender portion of said L-shaped keytop and a base situated under said keytop;

first means for mounting said first and second ends within the hollow portion of said ascender portion at longitudinally opposed ends thereof; and second means for mounting said third and fourth ends to said base;

said first and second mounting means adapted to provide articulating joints enabling said linkage to collapse in scissors-like fashion when said keytop is moved toward said base, whereby said scissors-like linkage maintains said keytop level throughout its movement toward and away from said base.

8. The mechanism of claim 7 wherein said first mounting means comprises studs projecting from said first and second ends which protrude into slots provided at longitudinally opposed ends of said ascender portion, and said second mounting means comprises studs projecting from said third and fourth ends which protrude into slots provided at said base.

9. The mechanism of claim 7 wherein said base comprises a frame situated above a circuit board to which a keyswitch actuated by said keytop is mounted.

* * * * *